United States Patent [19]

Frommeyer

[11] Patent Number: 5,028,386

[45] Date of Patent: Jul. 2, 1991

[54] PROCESS FOR THE PRODUCTION OF TOOLS

[75] Inventor: Georg Frommeyer, Erkrath, Fed. Rep. of Germany

[73] Assignee: Robert Zapp Werkstofftechnik GmbH & Co. KG, Dusseldorf, Fed. Rep. of Germany

[21] Appl. No.: 600,135

[22] Filed: Oct. 17, 1990

Related U.S. Application Data

[63] Continuation of Ser. No. 267,640, Nov. 3, 1988, abandoned, which is a continuation of Ser. No. 942,542, Dec. 16, 1986, abandoned.

[30] Foreign Application Priority Data

Dec. 18, 1985 [DE] Fed. Rep. of Germany ..... 3544759

[51] Int. Cl.[5] ..... B22F 3/24

[52] U.S. Cl. ..... 419/12; 419/14; 419/23; 419/28; 419/29; 419/30; 419/31; 419/32; 419/38; 419/43; 419/49

[58] Field of Search ..... 419/12, 30, 31, 14, 419/32, 38, 23, 28, 29, 43, 49

[56] References Cited

U.S. PATENT DOCUMENTS

| | | | |
|---|---|---|---|
| 3,976,482 | 8/1976 | Larson | 419/23 |
| 4,073,648 | 2/1978 | Volin et al. | 75/246 |
| 4,582,536 | 4/1986 | Raybould | 75/246 |

FOREIGN PATENT DOCUMENTS

| | | |
|---|---|---|
| 2206632 | 9/1976 | Fed. Rep. of Germany . |
| 3346089 | 7/1985 | Fed. Rep. of Germany . |

OTHER PUBLICATIONS

H. Ruhfus, "Warmebehandlung der Einsatzstoffe", 1958, pp. 75 to 78.

*Primary Examiner*—Stephen J. Lechert, Jr.
*Attorney, Agent, or Firm*—Toren, McGeady & Associates

[57] ABSTRACT

In a process for making tools from medium and high alloy steels or stellites by superplastic precision forming a powder metallurgically produced starting material with an equiaxed structure and more than 30% by volume of carbidic and/or boridic precipitated phase of particle size 1 to 0.2 μm is given a matrix grain size of 1 to 3 μm by thermomechanical processing (hot forming) and formed in the superplastic state.

13 Claims, 1 Drawing Sheet

PROCESS FOR THE PRODUCTION OF TOOLS

This is a continuation of Ser. No. 07/267,640 filed Nov. 3, 1988, abandoned, which is a continuation of Ser. No. 06/942,542, filed Dec. 16, 1986, abandoned.

TECHNICAL FIELD OF THE INVENTION

The invention relates to a process for the production of tools from alloy steels or stellites by hot forming.

BACKGROUND OF THE INVENTION

Tool steels and stellites or hard metals are generally characterised by high contents of carbon, chromium, cobalt, molybdenum, vanadium and tungsten. These elements, and the corresponding carbides, give the material the necessary strength, in particular wear resistance and hardness. However, this is mostly at the expense of toughness, and is associated with a corresponding increase in resistance to deformation.

High deformation resistance precludes both cold-working and also conventional hot-working as methods for producing the finished contour, so that, only initial shaping by ingot casting or continuous casting, followed by rolling or forging, or by casting into a mould or compacting from powder, come into consideration. These processes however generally require the initially formed part to be machined to the finished contour and size. But it is just in the case of wear-resistant parts that this causes difficulties, inasmuch as the machining requires the use of tools having substantially greater wear resistance than that of the part to be machined. Moreover machining involves substantial loss of material. Substantial working costs are therefore incurred without always obtaining good surface finish.

Added to this are disadvantages specific to the process such as the high energy cost of hot-rolling and -forging, or impairment of surface quality by intensive oxidation of the alloys. A further disadvantage, particularly in respect of intricate finished shapes, is the mostly inadequate flowability during both initial shaping and casting in moulds. This leads to starting pieces that differ considerably from the finished part and therefore require so much machining that substantial losses of material occur. The associated costs are quite considerable on account of the high content of expensive alloying elements in the material concerned. In addition the high resistance to deformation results in high deformation forces being needed, and thus in correspondingly costly working equipment and high energy costs.

OBJECT OF THE INVENTION

The object of the invention is to provide a process that avoids the above-mentioned disadvantages and allows finished parts to be made from alloys whose high resistance to deformation normally precludes their being plastically deformed, or at best only permits them to be shaped into blanks that require machining.

SUMMARY OF THE INVENTION

The solution of this problem consists, in a process of the kind referred to in the introduction, in thermomechanically working a powder-metallurgically produced starting material having more than 30% by volume of precipitated carbidic and/or boridic phase, to give an equiaxed structure and a grain size of preferably 0.2 to 3 μm, and forming it in the superplastic state. The small grain size ensures a low yield stress through grain boundary slip, and thus reduces both the force needed for plastic deformation and the tool wear.

The process according to the invention therefore takes place in two stages. The first stage serves to further refine, in the consolidated state, the powder-metallurgically produced multiphase structure of the alloy powder in respect both of the matrix and of the carbidic and/or boridic precipitated phase, the said powder already being finely crystalline and preferably already equiaxed as a result of the high rate of cooling during atomisation of, for example, $10^4$ to $10^5$ degrees K/second, so as to give a thermally stable microstructure with a fine grain size, preferably for the matrix of 1 to 3 μm and for the precipitated phase of 0.2 to 1 μm on subsequent thermomechanical processing, as a result of hot plastic deformation in the second stage.

The conditioning of the structure of the material in the first stage of the process can occur through a thermomechanical processing. In the case of the alloy steels this begins in the austenitic state, for example at about 900° C., and passes through the $\gamma/\alpha$ phase transformation in the range of 750° to 820° C. to a final rolling temperature of 650° C. During the hot working, for example rolling or forging, the workpiece continuously cools down, and precipitation of the carbides or borides occurs as well as the phase change.

In a similar manner, when stellites are hot worked, the carbides and/or borides precipitate in the temperature range of about 1,000° to 700° C. during the forming and the associated continuous cooling. Furthermore, during the thermomechanical conditioning not only is there refining of the matrix grains, which are equiaxed at the latest at that stage, but also a more finely-dispersed distribution of the carbide and boride particles comes about as a result of the favourable conditions for nucleation during the phase transformation. These both tend to increase the strength of the material.

Furthermore, the conditioning of the powder-metallurgically produced starting material can also take place through isothermal forming for the purpose of recrystallising the structure and obtaining a finer-grained structure as a prerequisite for the superplastic state. The isothermal forming takes place at temperatures below the transformation temperature, for example at 450° C., and preferably with a low degree of deformation, e.g. with a reduction in area of about 10%, and should include a cyclic $\gamma/\alpha$ phase transformation that leads to internal stresses as a result of the different volumes of the $\gamma$ and $\alpha$ phases, and thus to deformation of the matrix grains induced by internal stresses. To refine the matrix grain size of the hot isostatically pressed blank, this can be followed by a short primary recrystallisation annealing, e.g. for 20 to 60 seconds, which leads to further grain refinement.

The overall object of the conditioning of the starting material is to obtain an equiaxed structure for the superplastic forming in the second stage of the process, characterised by a fine grain structure favourable to plastic deformation. Thus with decreasing grain size the resistance to deformation decreases, allowing the rate of deformation to increase at the same time.

In the second stage the material that has been plastically deformed and given a particular multiphase structure is shaped at a temperature in the order of 50 to 70% of the melting temperature, for example, 650° to 780° C., which allows large deformations at low yield stresses and therefore enables intricately shaped finished parts to be made even from alloys whose composition does not allow them to be shaped by plastic deformation without the special pretreatment of the first stage of the process according to the invention. The rate of deformation is advantageously from $10^{-3}$ to $5\times10^{-1}\,s^{-1}$. The exponent m of the rate of elongation, as given by the equation $$s=K\cdot\dot{e}^{m}$$

where s is the yield stress, K is a constant for the material and $\dot{e}$ is the rate of deformation or creep rate of 0.4 to 0.5 for steel alloys and of 0.35 to 0.4 for stellites. It follows from this that the shaping requires very low yield stresses or deforming forces. Since in addition it is performed at relatively low temperatures, the process according to the invention is characterised, particularly when the conditioning takes place in the first stage by isothermal shaping below the transformation temperature, by low costs as regards both the plant required and energy consumption.

The plastic deformation temperature is below the temperature of incipient secondary crystallisation or grain growth, since each grain growth increases the resistance to deformation and thus requires higher deforming forces.

The process according to the invention is particularly suitable for high-carbon cold-work steels such as X 178 Cr V 5 2 9
X 155 Cr V W Co 4 5 12 5
X 135 Cr V W Mo 4 4 6 4
X 220 Cr V 17 6
X 245 Cr V 5 10.

These have carbon contents from 1.0 to 2.5% and high contents of chromium, vanadium, tungsten, molybdenum and cobalt of 4 to 17%.

Other suitable alloys are the following:

X 375 Cr Mo Fe 25 10 60
X 220 Cr W Co 30 12 56
X 120 Cr Mo Co 27 4 60
X 100 Cr W Co N B 15 15 52 3.

The stellites are iron- or cobalt-based stellites with high boron and carbon contents of 1 to 4% and contents of the alloying elements chromium, molybdenum and tungsten of 15 to 30%, which can be worked at a relatively low temperature of 650° to 720° C.

The superplastic shaping can be followed by a grain-coarsening annealing in order to increase creep-resistance or hot strength.

BRIEF DESCRIPTION OF THE DRAWINGS

The invention will now be described in more detail by way of example with reference to an embodiment illustrated in the drawings, in which.

DETAILED DESCRIPTION OF A PREFERRED EMBODIMENT OF THE INVENTION

Figure 1:
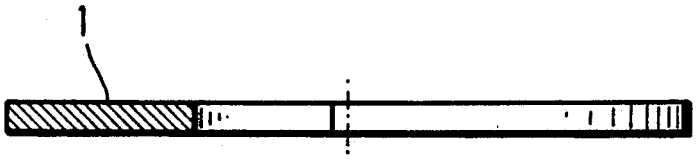
FIG. 1 shows a side elevation of a round for the production of a rotary knife, partly in section.

The round 1 shown in FIG. 1 consists of the high-strength cold work steel X 245 Cr V 5 10, made powder-metallurgically by hot isostatic pressing and given a structure with a matrix grain size of 1 to 3 μm. It is used for the production of the disc-shaped rotary knife shown in FIG. 2 which has a conical angle f of 150° to 160°, a thickness of 1.0 to 1.5 mm, an internal diameter of 50 mm and an external diameter of 100 mm.

The round 1 was made by stamping from a 100×200×8 mm plate produced powder-metallurgically and then rolled at a temperature of 1150° to 1250° C. to a thickness of 2.5 mm. To provide a sufficient reserve of material for the formation of the blades 2 of the rotary knife, the thickness of the plate exceeded the finished thickness of the rotary knife by 1 mm.

Figure 2:
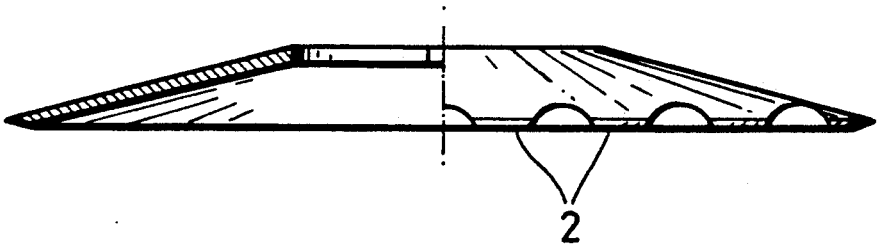
FIG. 2 shows, partly in section, the rotary knife made from the round of FIG. 1 by superplastic forming.

The round 1 had a diameter of 95 mm and a thickness of 2.5 mm, and after the stamping it was heated to a temperature of 760° C. and plastically deformed by means of a conventional tool consisting of upper and lower dies, preheated to 350° C., at a deformation rate of $5\times10^{-3}\,s^{-1}$ in a processing time of 25 s to the rotary knife shown in FIG. 2, as given by the equation $$\Delta\,tp=\frac{\epsilon}{\dot{\epsilon}}=\frac{\frac{\Delta A}{A_o}}{\dot{\epsilon}}$$

wherein $A_o$ is the annular surface of the round 1, and $\Delta A$ is the conical surface A, reduced by the area $A_o$ of the slot profile $\epsilon$, and $\dot{\epsilon}=5\times10^{-1}\,s^{-1}$.

The low plastic deformation temperature saves energy, minimises scaling and inhibits harmful grain growth. Also a higher density is obtained on superplastic deformation together with higher strength and toughness, since pores and cracks weld up. Because no machining is needed, machining scores that could lead to fatigue cracking are not formed, thus increasing the life of a tool by 25 to 30%.

The plastic deformation time was found experimentally to be 25 s., in good agreement with the calculated value. Adding to this a setting-up time for the tool of 35 s, a production time of 60 s is obtained for the tool, which is far less than the working time for machining a blank.

The process according to the invention is suitable for the production of cutting bells and tools, formcutting tools, knives, for example disc, filter and tobacco knives having a thickness of less than 3 mm, coining tools, retaining rings and pressure rings for extruders, sintering press tools, extrusion press tools and dies, shaping tools for shaking extrusion presses and multi-hole plates, all of cold-work steels; for the production of profile milling cutters, form turning tools and profile sinking heads of high-speed steels; and for making glass blowing mould tools, profile bars, nozzles, running wheels, turbine discs and valve seats of stellites. It is characterised by low deformation temperatures and a low power requirement. The finely dispersed, equiaxed and texture-free microstructure ensures constant and reproducible mechanical properties, in particular high strength with excellent ductility and good fatigue properties. The sizing and surface quality are so good that no finishing is necessary. Thus the surface roughness is normally less than 1 μm.

What is claimed is:

1. A process for the production of tools from alloy steel or stellites, comprising preparing from alloy steel powder a starting material with 30% by volume of carbidic and/or boridic precipitated phase, hot-working the powder of alloy steel below the transformation temperature with an alpha/gamma phase transformation isothermally or in the austenitic state, or hot-working the stellite powder at 700° to 1000° C., so that an equiaxial structure of the hot-worked starting material is obtained with a matrix grain size of 1 to 3 micrometers and a precipitated phase grain size of 0.2 to 1 micrometers, and subsequently superplastically deforming the hot-worked material.

2. A process according to claim 1, wherein powder-metallurgical tool steels and stellites are superplastically formed at temperatures of about 0.5 to 0.7 Tm and then continuously cooled.

3. A process according to claim 2, wherein the working temperature during preparing the starting material of alloy steel is from 900° to 650° C.

4. A process according to claim 1, wherein the stellitic starting material is hot-formed in the course of continuous cooling from 1000° to 760° C.

5. A process according to claim 2, wherein the deformation resulting from superplastically forming is more than 30% and the elongation amounts to some hundreds percent.

6. A process according to claim 5, wherein the deformation resulting from superplastically forming is up to 800%.

7. A process according to claim 1, wherein grain boundary slip and dynamic recrystallisation at 600° to 700° C. occur during hot-forming.

8. A process according to claim 1, wherein the superplastic forming is at a temperature below the secondary recrystallisation and grain growth temperature.

9. A process according to claim 1, wherein the alloy steels are superplastically formed at 650° to 780° C.

10. A process according to claim 8 wherein the rate of deformation $\epsilon = 10^{-3}$ to $10^{-1}\ s^{-1}$.

11. A process according to claim 8, wherein the elongation rate exponent m = from 0.4 to 0.5.

12. A process according to claim 8, wherein the elongation rate exponent m = from 0.35 to 0.4 for stellites.

13. A process according to claim 8, wherein the shaped article is subjected to grain coarsening annealing.

* * * * *

UNITED STATES PATENT AND TRADEMARK OFFICE

CERTIFICATE OF CORRECTION

PATENT NO. : 5,028,386

DATED : July 2, 1991

INVENTOR(S) : George Frommeyer

It is certified that error appears in the above-identified patent and that said Letters Patent is hereby corrected as shown below:

In the Abstract, line 2, change "stellites" to --cobalt alloys--

Column 1, line 10, change "stellites" to --cobalt alloys--;
line 13, change "stellites" to --cobalt alloys--;

Column 2, line 27, change "stellites" to --cobalt alloys--;

Column 3, line 12, change "stellites" to --cobalt alloys--;
line 41, change "stellites" to --alloyed steels--
(first occurrence);
delete "stellites" (second occurrence);

Column 4, line 51, change "stellites" to --cobalt alloys--;
line 62, change "stellites" to --cobalt alloys--;
line 68, change "stellites" to --cobalt alloys--, Column 6, line 17, change "stellites" to --cobalt alloys--.

Signed and Sealed this

Fifteenth Day of June, 1993

Attest:

Michael K. Kirk

MICHAEL K. KIRK

Attesting Officer

Acting Commissioner of Patents and Trademarks